United States Patent [19]

Belmuth et al.

[11] 4,115,938

[45] Sep. 26, 1978

[54] VARIABLE PICTURE FRAME ASSEMBLY

[75] Inventors: Harold M. Belmuth, Westport, Conn.; Alfred R. Leto, Springfield, Mass.; Lawrence London, Norwalk; Herman A. Zuckerman, Westport, both of Conn.

[73] Assignee: Saugatuck Industries, Incorporated, Westport, Conn.

[21] Appl. No.: 753,287

[22] Filed: Dec. 22, 1976

[51] Int. Cl.[2] ..... G09F 1/12

[52] U.S. Cl. ..... 40/152

[58] Field of Search ..... 40/152, 152.1, 125 F, 40/125 H

[56] References Cited

U.S. PATENT DOCUMENTS

| | | | |
|---|---|---|---|
| 547,377 | 10/1895 | Gillbee | 40/152.1 |
| 1,784,937 | 12/1930 | Kreslwsky | 206/461 |
| 2,367,071 | 1/1945 | Tarlitz | 40/152.1 |
| 2,844,901 | 7/1958 | Eisen | 40/158 R |
| 3,288,280 | 11/1966 | Bostrom | 206/461 |
| 3,466,777 | 9/1969 | Wistrand | 40/125 F |
| 3,523,382 | 8/1970 | Dreyer | 40/152 |
| 3,685,649 | 8/1972 | Diehl | 206/462 |
| 4,017,989 | 4/1977 | Murray | 40/152 |
| 4,020,694 | 5/1977 | Mayhew | 206/461 |

FOREIGN PATENT DOCUMENTS

| | | | |
|---|---|---|---|
| 2,035,718 | 7/1970 | Fed. Rep. of Germany | 40/125 H |

*Primary Examiner*—Louis G. Mancene
*Assistant Examiner*—Wenceslao J. Contreras
*Attorney, Agent, or Firm*—Allen D. Brufsky

[57] ABSTRACT

A variable picture frame assembly in which adjacent frames are joined together by snap-on clips which fit over and engage the sidewalls of the frames. Two types of clips are described, one that is U-shaped for connecting adjacent frames in a planar array and another that is double U-shaped for connecting adjacent frames in an angular array. The clips and frames in unassembled form are enclosed for display and merchandising in a blister package in which the base card has cuts formed on it defining backings for the frames.

6 Claims, 13 Drawing Figures

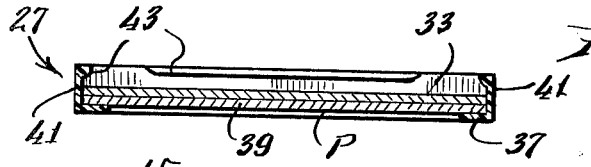
Fig. 6.
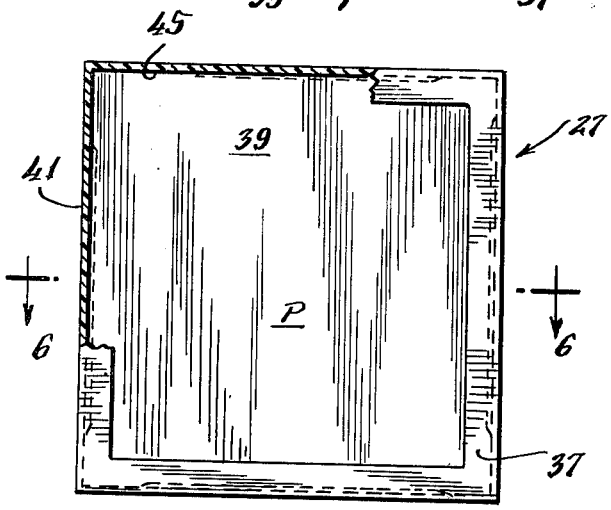
Fig. 4.
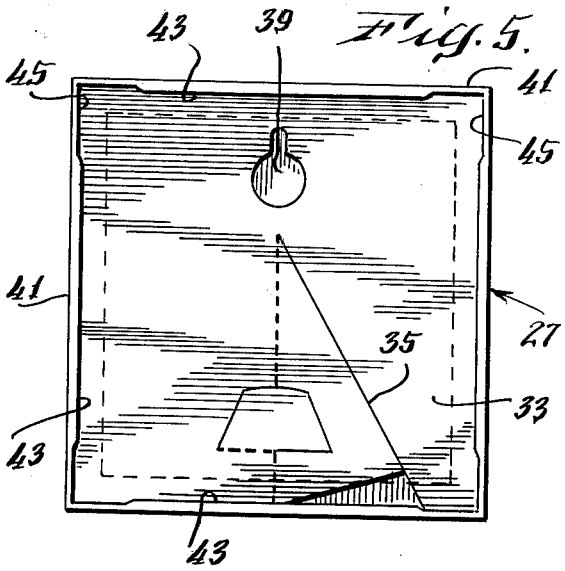
Fig. 5.
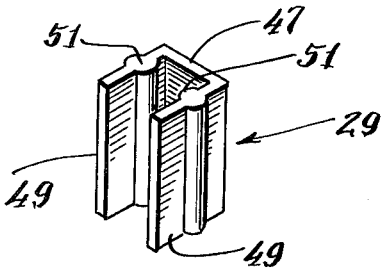
Fig. 7.
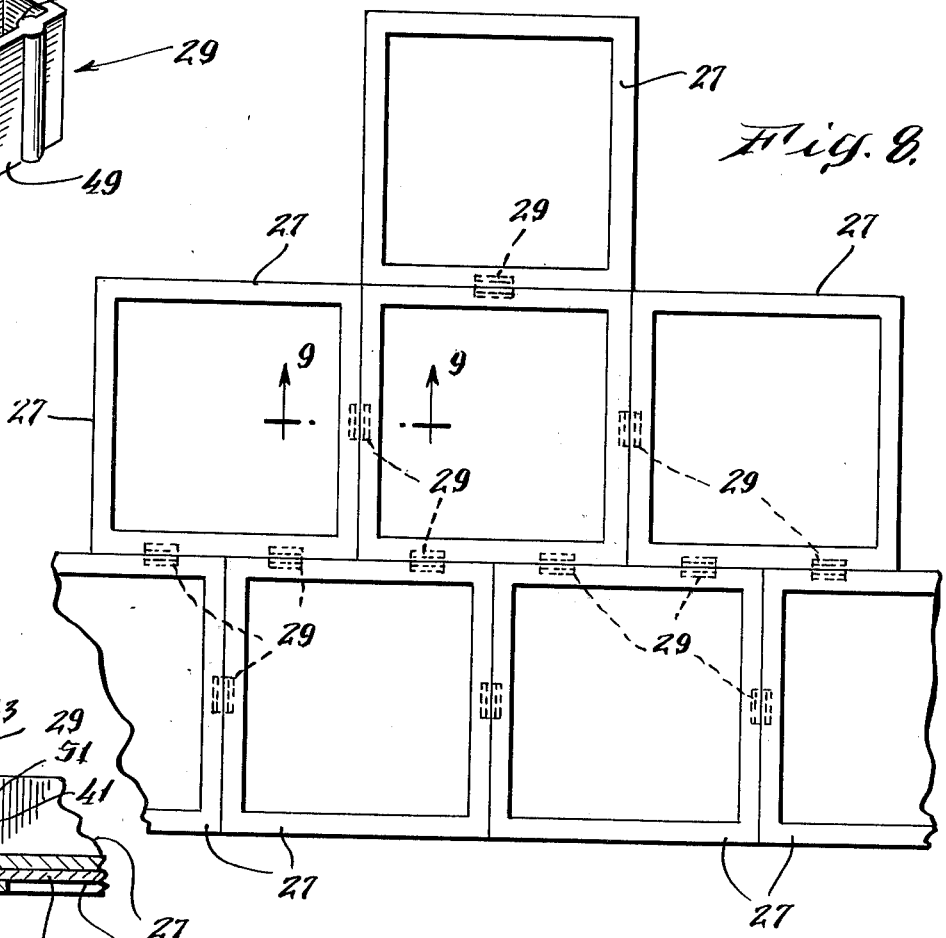
Fig. 8.
Fig. 9.
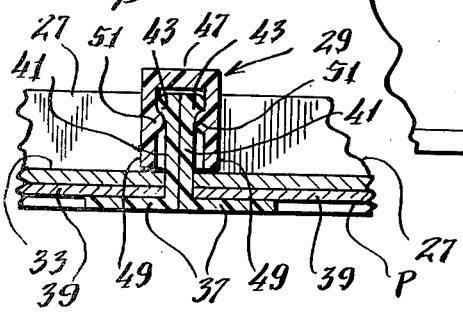

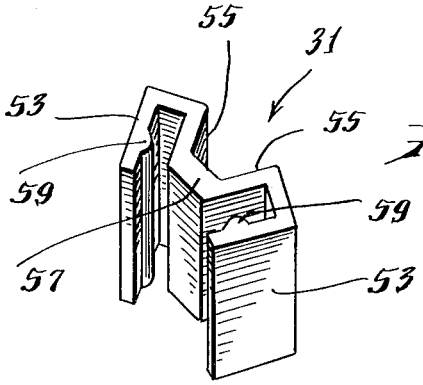
Fig. 10.
Fig. 11.
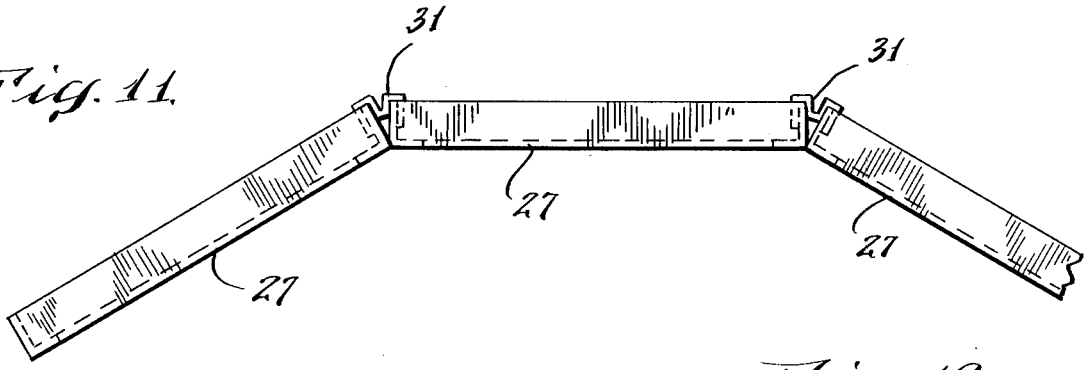
Fig. 12.
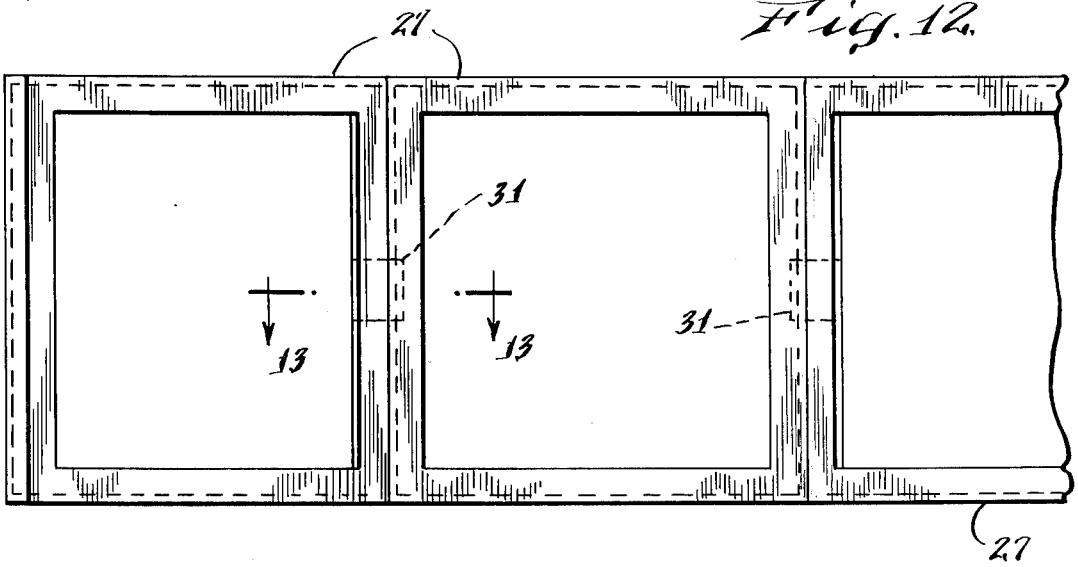
Fig. 13.
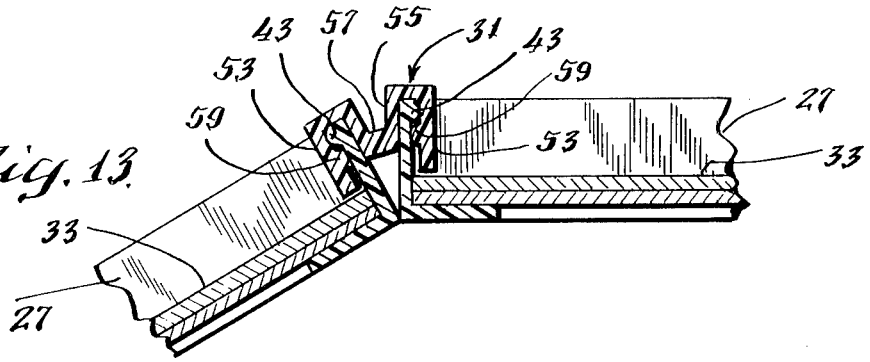

VARIABLE PICTURE FRAME ASSEMBLY

BACKGROUND OF THE INVENTION

This invention relates to picture frame assemblies. More particularly, this invention relates to variable picture frame assemblies.

A picture frame assembly is a collection of two or more framed pictures joined together in a composite group either for mounting purposes or for aesthetic appearance. A variable picture frame assembly is a type of picture frame assembly in which the number of frames in the assembly and/or the positioning of the different frames within the assembly relative to each other can be easily varied. Variable picture frame assemblies are well known in the art.

In U.S. Pat. No. 3,523,382 to R. L. Dreyer there is disclosed a variable picture frame assembly in which the individual frames are provided with integrally formed clips which cooperate with slots formed in the backwalls of the frames to secure adjacent frames together. In another variable picture frame assembly disclosed in Dreyer adjacent frames are connected together by means of separate clips which are inserted into slots formed in the backwalls of the frames. Other examples of variable frame assemblies in which adjacent frames are held together by clips fitting into slots can be found in U.S. Pat. No. 2,737,742 to N. J. Leigh, U.S. Pat. No. 3,471,959 to B. J. Seger and U.S. Pat. No. 3,722,122 to L. J. Sesto. In Leigh and Seger the slots are formed in the backing member for the frame, whereas in Sesto the slots are in the back walls of the frames. An example of a variable picture frame assembly in which adjacent frames are held together by integrally formed hooks can be found in U.S. Pat. Nos. 3,673,724 to R. P. Bell et al. and examples of variable picture frame assemblies wherein the frames are held together by hinges fitting into slots can be found in U.S. Pat. No. 3,132,432 to E. Yee, U.S. Pat. No. 3,529,374 to M. Spertus and U.S. Pat. No. 3,648,393 to S. C. Parrilla. Other patents considered pertinent in one way or another to this invention include U.S. Pat. No. 3,093,244 to C. W. Middleton, Jr., et al., U.S. Pat. No. 3,127,010 to J. P. Capezzuto and U.S. Pat. No. 3,460,282 to G. L. Swensky.

Generally speaking, in most all prior art variable picture frame assemblies, either the individual frames or the connecting elements contain structural details which render their fabrication costly. Also, the individual frames are connected in ways that are not entirely satisfactory from a mechanical standpoint and that tend to detract from the overall appearance of the assembly. In addition, the number and types of different arrangements in which the frames can be positioned relative to each other is somewhat limited. Consequently, variable picture frame assemblies have not thus far met with much commercial success.

SUMMARY OF THE INVENTION

Accordingly, it is an object of this invention to provide a new and improved variable picture frame assembly.

It is another object of this invention to provide a variable picture frame assembly in which the individual frames and connecting means for joining the frames together can be easily fabricated and wherein adjacent frames can be connected either in a planar relationship or an angular relationship.

It is still another object of this invention to provide a variable picture frame assembly in which the individual frames can be used as separate units if so desired.

It is yet still another object of this invention to provide a variable picture frame assembly in which the individual frames can be positioned relative to each other in a wide variety of arrangements.

It is another object of this invention to provide a new and improved arrangement connecting two adjacent picture frames to each other.

It is still another object of this invention to provide a picture frame assembly in which adjacent frames are connected in substantially abutting relationship without the use of slots, slits or holes.

It is yet still another object of this invention to provide a picture frame assembly in which the connecting means for joining together adjacent frames is not visible from the front.

It is another object of this invention to provide a picture frame assembly which is especially suited for making arrays of small size snapshots.

It is another object of this invention to provide a new and improved package for holding and displaying the disassembled component parts of a picture frame assembly and which contains portions which are used in the picture frame assembly.

It is still another object of this invention to provide a variable picture frame assembly in which any part of any side of one picture frame can be connected to any part of any side of any other picture frame in either a planar or angular relationship.

It is another object of this invention to provide a new and novel clip for use in connecting two adjacent picture frames so as to form a picture frame assembly.

The foregoing and other objects and advantages will appear from the description to follow. In the description, reference is made to the accompanying drawings which form a part thereof, and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

The present invention includes identical individual picture frames which are designed to be displayed either singly or in groups of two or more. The picture frames include a front wall having an opening therein to expose a picture mounted in the frame and a plurality of side walls on the front wall along the periphery thereof and extending rearwardly therefrom. The invention further includes separable snap-on type clips adapted to fit over the side walls of adjacent frames from the back for securing the frames together in a fixed relationship. Two versions of the snap-on clips are described, one that is generally U-shaped for connecting adjacent frames in a planar array and another that is generally double U-shaped for connecting adjacent frames in an angular array. Each picture frame further includes an easel containing backing that permits the frame to be self-supporting on a horizontal surface. According to another feature of the invention, the easel containing backings for the frames are formed directly on the back of the blister pack which is used to hold the component parts of the assembly in unassembled form for display and marketing purposes.

BRIEF DESCRIPTION OF THE DRAWINGS

In the drawings, wherein like reference numerals represent like parts:

FIG. 4 is a front plan view partly broken away in section of a picture frame constructed according to this invention;

FIG. 5 is a rear plan view of the picture frame shown in FIG. 4;

FIG. 6 is a section view taken along the lines 6—6 in FIG. 4;

FIG. 7 is a perspective view of a clip constructed according to the invention for use in connecting two picture frames of this invention in a planar array;

FIG. 8 is a partial plan view of a picture frame assembly constructed according to this invention wherein the individual frames are interconnected using the clip shown in FIG. 7;

FIG. 9 is an enlarged section view taken along lines 9—9 in FIG. 8;

FIG. 10 is a perspective view of a clip constructed according to this invention for use in connecting two picture frames constructed according to this invention in an angular array;

FIG. 11 is a top view of a picture frame assembly constructed according to this invention wherein the individual frames are interconnected in an angular array;

FIG. 12 is a front plan view of the picture frame assembly shown in FIG. 11; and FIG. 13 is an enlarged section view taken along lines 13—13 in FIG. 12.

DESCRIPTION OF PREFERRED EMBODIMENTS

Figure 1:
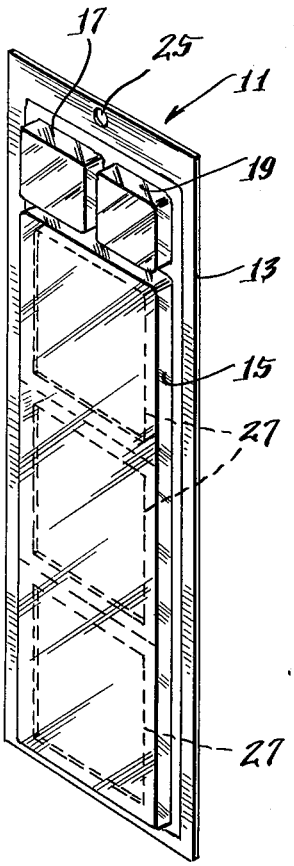
FIG. 1 is a perspective view of a blister package constructed according to the invention.
Figure 2:
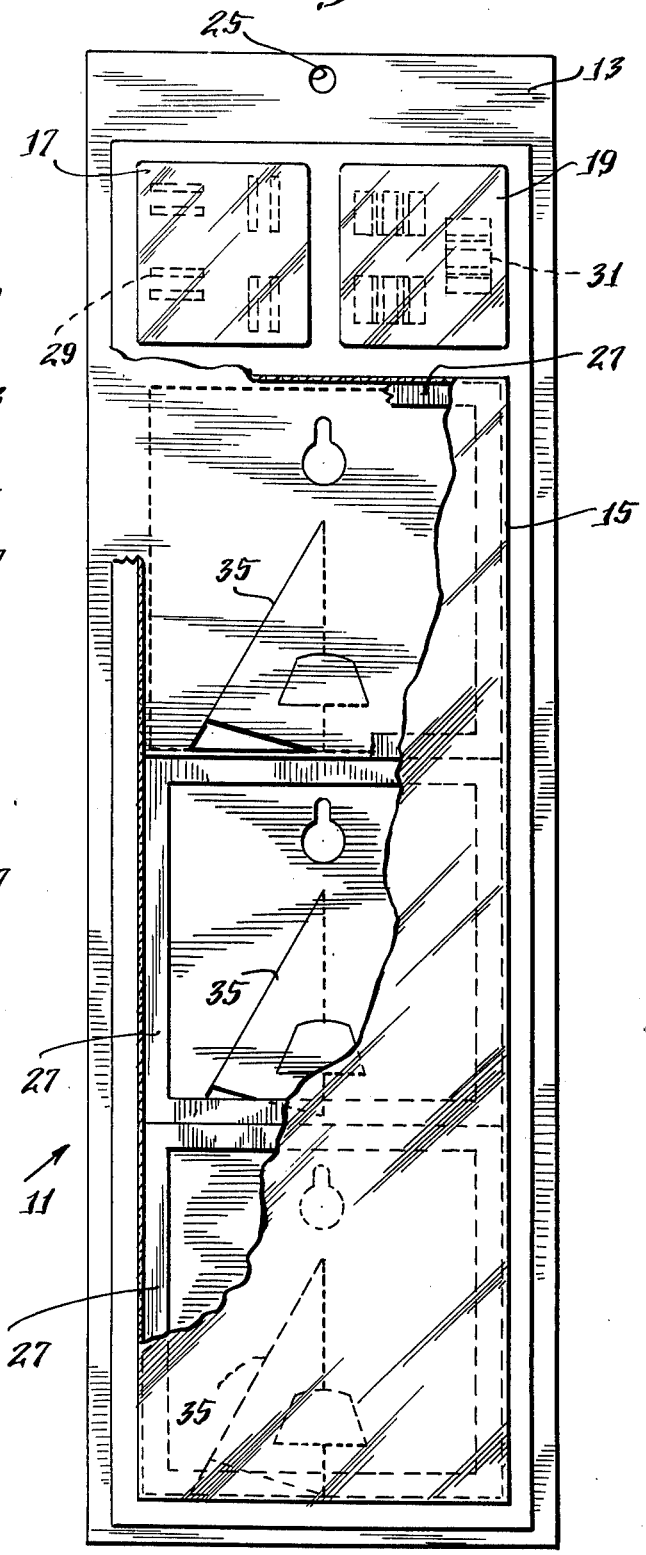
FIG. 2 is a front elevation view of the blister package shown in FIG. 1, partly broken away to illustrate more clearly the component parts of a picture frame assembly.
Figure 3:
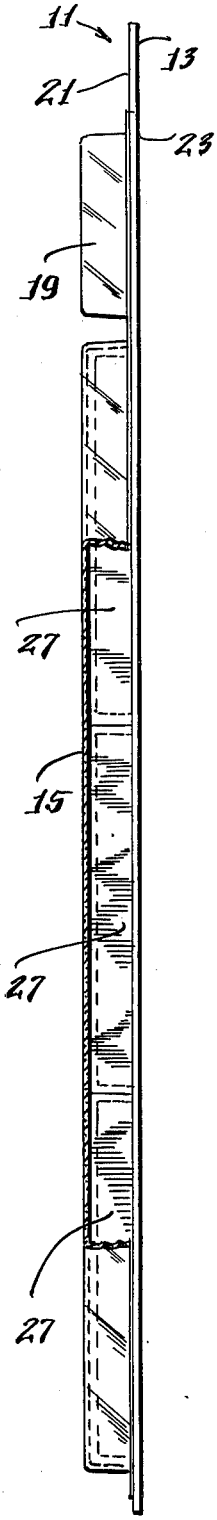
FIG. 3 is a side elevation view of the blister package shown in FIG. 2.

Referring now to the drawings, and in particular FIGS. 1 through 3, there is shown a blister package indicated generally by reference numeral 11. The package 11 comprises broadly a base element or card 13 and a plurality of blister elements 15, 17 and 19.

The base element 13 is preferably formed of stiff fibrous material, as is well known in the art, including a front surface 21 which may be coated with a thermoplastic layer (not shown) and a rear surface 23. The base element 13 may be provided with a hole 25 so that the package can be hung on a hook or similar device. The blister elements 15, 17 and 19 are made of a transparent, synthetic resinous material such as cellulose acetate or polystyrene, as is conventional in the art, are contoured by any convenient process, and are laminated onto the front surface 21 of the base element 13 by any means well known in the art. Disposed inside the blister element 15 is a plurality of picture frames 27 and inside the blister elements 17 and 19 are pluralities of clips 29 and 31 respectively. The base element 13 is further provided with appropriate cuts or perforations to define backing elements 33 for holding pictures within the frames. The backing elements 33 are provided with appropriate cuts to form integral easels 35 adapted to be swung into a propping position if the frame in which the backing element is inserted is to be used in a self-supporting mode.

Referring now to FIGS. 4 through 6 there is shown in detail the construction of one of the picture frames 27. As can be seen, the picture frame 27 is generally rectangular in outline and is of a one piece rigid construction, preferably molded of a stiff plastic material such as a polystryene base plastic material. In a preferred embodiment of the invention the frame is about 3½ inches long by 3½ inches wide for use with present day normal size snap shots such as are obtained from a Kodak INSTAMATIC® camera. The frame 27 includes a front wall 37 having an opening 39 therein to expose a picture P mounted within the frame 27 and held in by backing 33 and a plurality of planar side walls 41 on the front wall 37 along the periphery thereof and extending rearwardly at right angles with the front wall 37. A small lip 43 is formed on the inside face 45 of each sidewall 41 at its back edge and extends along the back edge, preferably from one end of the back edge to the other end of the back edge.

Referring now to FIG. 7 there is shown a perspective view of the clip 29 which is constructed according to the invention for use in connecting a pair of frames 27 in a planar array. The clip 29 is essentially a U-shaped element of one piece construction, preferably molded of a suitable stiff plastic material. The clip 29 includes a base portion 47 and two generally parallel leg portions 49. The inner face of each leg portion 49 contains a transversely extending bead or rib 51 which is spaced down about one-third of the way from the base portion 47. The distance between opposite faces of the leg portion 49 is about twice the width of the side walls 41 of the frame 27. In FIG. 8 there is shown a grouping of frames 27 connected by means of the clips 29 to form a planar array. In applying the clip 29 to connect adjacent frames 27 the leg portions 49 are simply placed over the sidewalls 41 of abutting frames and forced past the lips 43 so as to snap into tight fitting engagement with the sidewalls 41 as shown in FIG. 9.

In FIG. 10 there is shown a perspective view of a clip 31 which is constructed for use in connecting two of the frames 27 in an angular array. The clip 31 is essentially a rigid element of one piece construction, preferably molded of a suitable stiff plastic material in the shape of two U's connected together in side-by-side relationship at an angle of about 45°. Thus the clip 31 includes outer leg portions 53, inner leg portions 55 and a common connecting portion 57. The inner face of each outer leg portion 53 is provided with a transverse rib or bead 59 similar to the bead 51 in clip 29. The distance between opposing faces in each U-section is equal to the width of a side wall 41 of the frame 27.

In FIGS. 11 through 13 there is shown an angular array made up of three frames 27 joined together by means of the clips 31. In joining two frames 27 using the clip 31 each U-section of the clip 31 is snapped over one of the adjacent sidewalls 41 of adjacent frame 27.

As can be seen, the lips on the sidewalls of the frames and the beads on the clips combine to produce a snap-on type action as the clips are inserted over the sidewalls of the frames, resulting in a very secure bond between the two frames that are being joined together. Only one clip of either type is needed to attach two frames to each other. Also, it should be noted that by using both types of clips it is possible to put together assemblies that are combinations of planar arrays and angular arrays.

The embodiments of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A variable picture frame assembly comprising:

(a) a plurality of picture frames, each of said picture frames having a front wall having an opening to expose a picture mounted within the frame and a plurality of side walls along the front wall along the periphery thereof and extending rearwardly therefrom, each side wall including an inside surface and an outside surface, a lip formed on the inside surface of each side wall adjacent a back edge thereof extending along said back edge; and (b) connecting means for joining adjacent picture frames together, said connecting means comprising snap-on type removal clips, each clip including a pair of spaced leg portions containing a transversely extending bead adapted to fit over the lips on the inside surface of side walls of the adjacent frames to join the frames together.

2. The variable picture frame assembly of claim 1 and wherein the snap-on type clips are one piece, rigid and U-shaped and adapted to connect adjacent frames in a planar array.

3. The variable picture frame assembly of claim 1 and wherein the snap-on type clips are one piece, rigid and double U-shaped and adapted to connect adjacent frames in an angular array.

4. The variable picture frame assembly according to claim 3 and wherein said snap-on clip is a one-piece rigid member in the shape of two U's connected together in side-by-side relationship at an agle of about 45°.

5. The variable picture frame assembly of claim 1 and wherein the plurality of picture frames comprises at least three picture frames and wherein the connecting means includes at least one one piece, rigid and U-shaped snap-on clip and at least one double U-shaped snap-on clip.

6. In combination with the variable picture frame assembly of claim 1, a blister package for holding the frames and connecting means prior to assembly, said blister package including a planar base element and at least one blister and wherein said planar base element contains at least one easel formed thereon by perforations for use as a backing for one of said picture frames.

* * * * *